US005511774A

United States Patent [19]

Lyga

[11] Patent Number: 5,511,774

[45] Date of Patent: Apr. 30, 1996

[54] ADJUSTABLE PRESSURE ROLLER FEEDING ASSEMBLY

[75] Inventor: Thomas M. Lyga, Torrington, Conn.

[73] Assignee: Pitney Bowes Inc., Stamford, Conn.

[21] Appl. No.: 303,305

[22] Filed: Sep. 8, 1994

[51] Int. Cl.[6] ..... B65H 5/02

[52] U.S. Cl. ..... 271/273; 271/272

[58] Field of Search ..... 271/272, 273

[56] References Cited

U.S. PATENT DOCUMENTS

| | | | |
|---|---|---|---|
| 2,273,289 | 2/1942 | Rouan | 271/59 |
| 2,871,781 | 2/1959 | Schrempp | 101/235 |
| 4,946,085 | 8/1990 | Nilsson et al. | 271/272 X |

*Primary Examiner*—David H. Bollinger
*Attorney, Agent, or Firm*—Angelo N. Chaclas; Steven J. Shapiro; Melvin J. Scolnick

[57] ABSTRACT

There is disclosed an adjustable pressure roller assembly for use in a paper feeding machine having a paper feed path and a feed roller for feeding various paper items, such as envelopes, single sheets, a plurality of layered sheets, etc. along the feed path. The pressure roller assembly has a back up pressure roller disposed on the opposite side of the feed path in juxtaposition to the feed roller of the paper feeding machine. There is structure for mounting the pressure roller for movement toward and away from the feed roller to vary the amount of pressure exerted by the pressure roller against a paper item disposed between the pressure roller and the feed roller. An actuating assembly is provided for controlling the direction and extent of movement of the pressuer roller So that the pressure roller and feed roller can accommodate a wide variety of thicknesses, types and grades of paper without risk of mutilating or misfeeding the paper.

8 Claims, 3 Drawing Sheets

ADJUSTABLE PRESSURE ROLLER FEEDING ASSEMBLY

BACKGROUND OF THE INVENTION

The present invention relates generaly to the field of paper feeding machines, and more particularly to an adjustable pressure roller assembly for maintaining proper feeding pressure on various types of paper and paper assemblies between a feed roller and a backup pressure roller, including the application of no pressure at all.

The present invention was conceived, designed and developed in connection with the development of various improvements in a high volume mailing machine, but it has since become apparent that the utility of the invention is not limited to the application for which it was originally intended, but rather extends beyond that as discussed further below. For the purpose of illustration, however, the invention is herein disclosed primarily in connection with mailing machines for which it was originally designed.

Most high volume mailing machines typically comprise an envelope storage and feeding module in which a stack of envelopes is placed in a hopper with the flaps of the envelopes lying in an open position, and from which they are fed one at a time into the mailing machine for further processing. The storage and feeding module also includes a moistening device which applies moisture to the gummed surface of the envelope flaps as they move along a feed path. The module further includes a flap closing device which has appropriately shaped guide surfaces for gradually closing the envelope flaps after they have been moistened, although this guide does not normally close the flaps sufficiently far to effect a seal between the flap and the rear surface of the envelope. In many mailing machines, the envelopes are then fed between a pair of rollers which apply a fixed pressure to the flap to cause it to seal to the envelope. In some mailing machines, the pressure required to seal the envelope is provided merely by a vertically movable platen which presses the envelope against a printing die to cause a postage indicia to be printed on the envelope.

In either event, certain problems have developed as mailing machines have increased in speed of operation and in the variety of types of envelopes which can be accommodated by the mailing machine. One problem has been that if the pressure rollers are set to apply sufficient sealing pressure for normal mail pieces having from one to three or four sheets in the envelope, they will apply excessive pressure to very thick envelopes (e.g. inch or more), thereby either damaging the envelope or its contents, or causing a jam in the mailing machine due to improper feeding. On the other hand, if the pressure rollers are set to apply normal sealing pressure for thick envelopes, they will not provide sufficient pressure to cause an effective seal between the flap and the back surface of the envelope. It has been found that there is a rather narrow range of sealing pressure that is required to effectively seal an envelope flap which is sufficient to squeeze out excessive moisture while not providing excessive pressure that may damage the envelope or cause a misfeed. Thus, it is desireable to have a pressure feeding assembly which is fully adjustable within the range of sealing pressures that will effectively accommodate all thicknesses of envelopes which may be normally processed through a particularly mailing machine.

Many other situations have been appreciated where it is desireable to have an adjustable pressure roller assembly in which the pressure applied to paper being fed betweeen two rollers can be adjusted or removed altogether. For example, with respect to pressure adjustment, in a paper feeding machine in which very thin or fragile paper is being fed, it can become critical to apply a proper amount of feeding pressure between a feeding roller and a backup pressure roller within a very narrow range of pressure in order to avoid the possibility of the paper being creased or otherwise mutiliated. Some forms of paper have very smooth or calendared surfaces, and others have very rough, almost blotter-like surfaces, each of which requires an appropriate amount of feeding pressure to avoid mutiliation or misfeed of the paper. In either of these cases, the use of a backup roller which is spring biased toward the feed roller with a fixed tension spring has been found to be inadequate in many situations where it is desired that the same machine accommodate different types or grades of paper at different times. Also, if it desired to feed multiple layers of paper through a machine, it is possible for excessive pressure to cause the layers to become misaligned by being forcibly squeezed through the roller assembly, or alternatively to become misaligned becuase the sheets are fed with insufficient feeding pressure between the rollers.

On the other hand, with respect to complete removal of feeding pressure, it often happens that a mailing machine is used in a non-printing mode for the purpose of merely sealing envelopes on which no postage indicia is being printed. One example if this type of operation is the sealing of envelopes containing pay checks of corporate employees which are then delivered by hand through the internal corporate mail distribution system. If a mailing machine is used in which envelope flap sealing is accomplished by application of a platen pressing the envelope against a printing die, it is apparent that the envelope will not be sealed if the postage printing assembly of the mailing machine is not used. Also, envelopes such as self mailers which are used for such forms as W-2s, jury notices, etc., which are sealed all around and are opening by separating one side of the envelope along score lines, do not have flaps that are sealed in the normal manner, and therefore do not require pressure sealing, thereby removing the potential for mutiliating the envelopes. Some of these envelopes have carbon on one side since they are addressed after the form is inserted, and excessive pressure from a pressure sealing assembly could cause an undesirable amount of carbon to transfer from the envelope to the form. It is thus apparent that there is considerable need over a broad range of utility for a simple and effective adjustable pressure roller feeding assembly as hereinafter disclosed and claimed.

BRIEF SUMMARY OF THE INVENTION

The pressent invention provides an adjustable pressure roller assembly that effectively solves the problems associated with other pressure feeding devices and fulfills the need for a pressure roller assembly having sufficient versatility to be useful in a wide variety of paper feeding situations.

In its broadest aspects, the invention is applicable to paper feeding machines having a feed path along which various items of paper, such a single or multiple sheets, envelopes, etc., are adapted to be fed, the machine having feed roller means disposed on one side of the feed path for feeding the paper items along the feed path. In this environment the invention comprises an adjustable pressure roller device for maintaining proper feeding pressure between the paper items and the feed roller means, the device including a back up pressure roller disposed on the opposite side of the feed path in juxtapostion to the feed roller means, means mounting the pressure roller for movement toward and away from the feed roller means to vary the amount of pressure exerted by the pressure roller against a paper item disposed between the presure roller and the feed roller means between a preset maximum and zero, and actuating means for controlling the direction and extent of movement of the pressure roller.

In some of its more limited aspects, the means mounting the pressure roller comprises an elongate housing mounted in spaced relationship to the paper feed path, means mounted adjacent one end of the housing for movably supporting the pressure roller for movement toward and away from the feed roller means, and resilient means interconnected between the supporting means and the housing for normally urging the pressure roller toward the feed roller means. The actuating means is manually adjustable and includes a threaded shaft rotatably supported in the housing adjacent the end thereof opposite the end that on which the pressure roller supporting means is mounted, a slider non-rotatably mounted on the shaft which is threadedly engaged therewith for moving therealong in response to rotation of the shaft. There is means mounted on the slider for engaging a portion of the pressure roller supporting means to move the latter in a direction which moves the pressure roller away from the feed roller means against the bias of the resilient means in response to rotation of the shaft in one direction.

Having briefly described the general nature of the present invention, it is a principal object thereof to provide an adjustable pressure roller device for use with any type of paper feeding machine which requires a roller feeding device in which the feeding pressure is infinitely adjustable from a preset maximum to zero.

It is another object of the present invention to provide an adjustable pressure roller device which can be easily mounted on any paper item processing machine in which an auxiliary feeding device is required without major modification to the processing machine.

It is still another object of the present invention to provide an adjustable pressure roller device in which the tension exerted by a resilient means, which provides the pressure exerted by the pressure roller on a backup feed roller, remains constant throughout the range of movement of the pressure roller regardless of the position of the pressure roller with respect to the feed roller means.

These and other objects and advantages of the present invention will become more apparent from an understanding of the following detailed description of a presently preferred embodiment of the invention when considered in conjunction with the accompanying drawings.

DETAILED DESCRIPTION OF THE INVENTION

Figure 1:
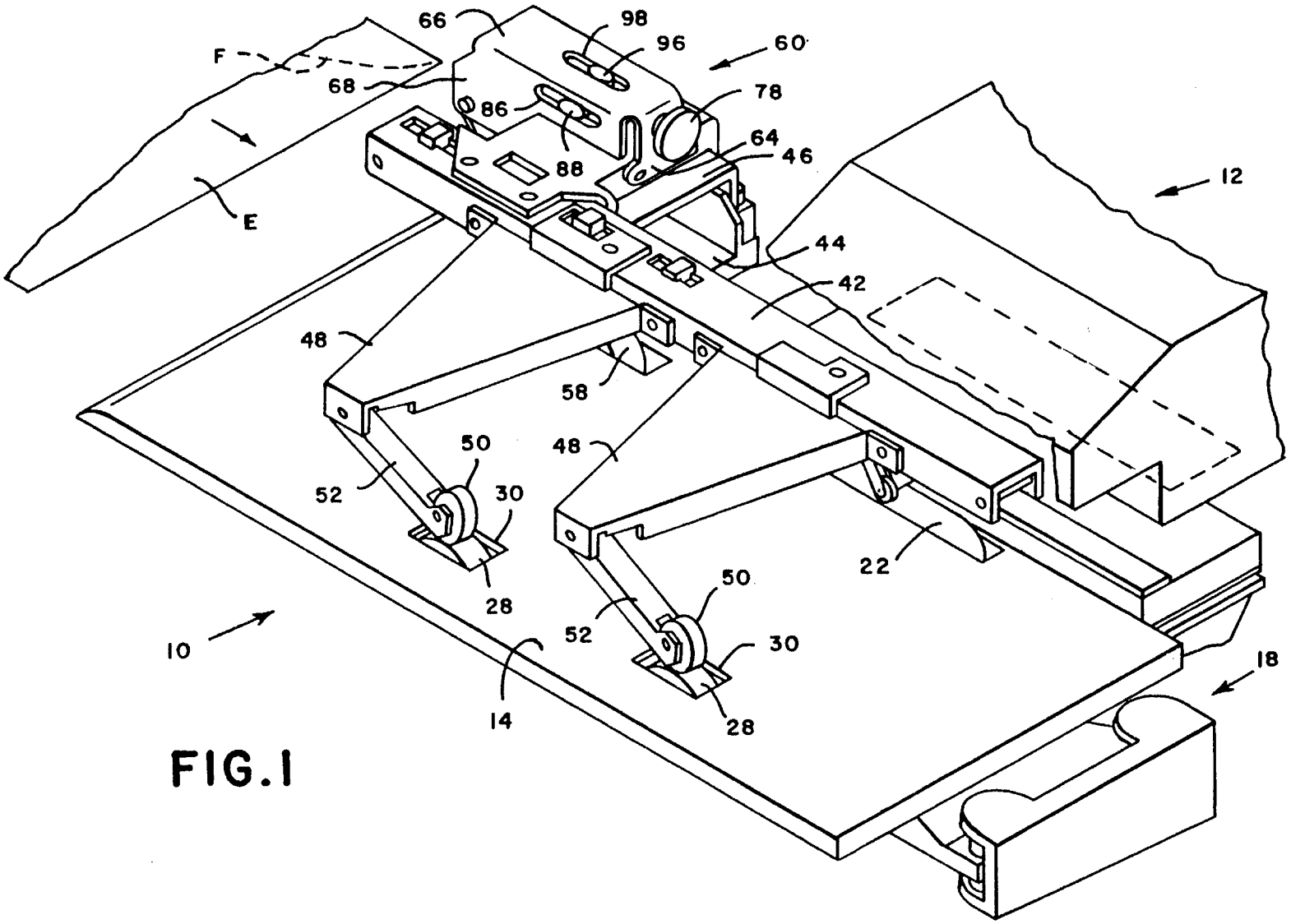
FIG. 1 is a prespective, partly fragmentary view of the scale and postage meter modules of a mailing machine for which the present invention was originally designed and intended for use, with the pressure roller assembly of the present invention mounted thereon.

Referring now to the drawings, the adjustable pressure roller device of the present invention is herein disclosed in conjunction with a mailing machine of the type for which the pressure roller device was originally designed and intended for use. It should be understood, however, that this is merely for the purpose of illustration and that the device of the present invention can be used with any type of paper feeding machine which requires an adjustable pressure roller feeding assembly as fully explained hereinabove.

With reference firstly to FIG. 1, there is seen a portion of a mailing machine which includes an envelope storing and feeding module (not shown since it forms no part of the present invention) from which envelopes E have been fed seriatim along a feed deck after the flaps F of the envelopes have been moistened and moved to a substantially closed position by suitable guide means in the feeding module, all in a manner well known in the art and not requiring further description for a full understanding of the present invention.

Figure 2:
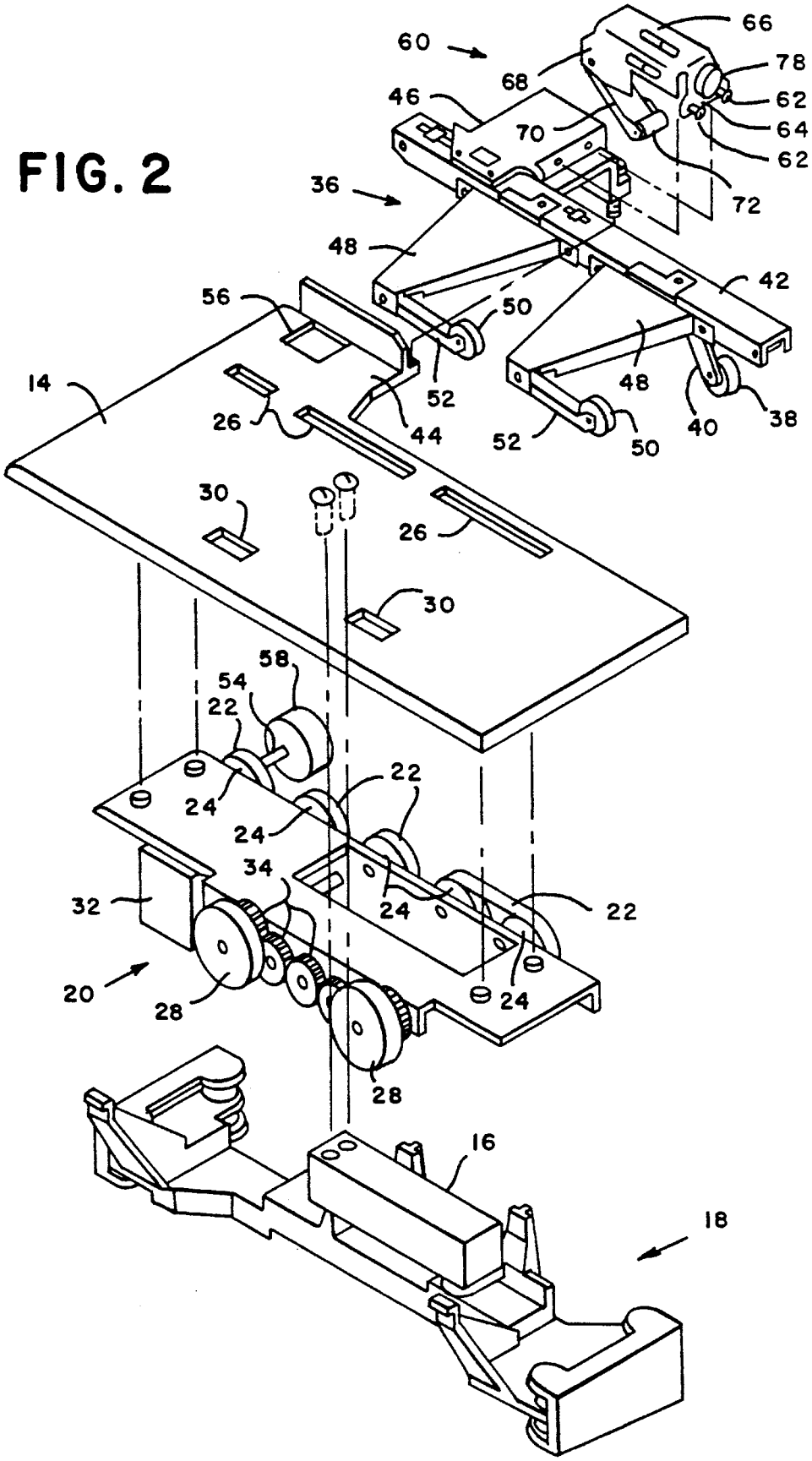
FIG. 2 is an exploded view of the scale module shown in FIG. 1 illustrating certain features of the envelope drive of the scale module and further details of the pressure roller assembly of the present invention.

Referring now to FIGS. 1 and 2, the mailing machine also include a scale module, indicated generally by the reference numeral 10, which receives the envelopes E from the aforementioned storing and feeding module for the purpose of weighing each envelope to determine the amount of postage to be printed on the envelope by the printing mechanism of a postage meter module, indicated generally by the reference numeral 12. The scale module 10 includes a generally rectangular platform 14 which is supported by a load cell 16, which in turn is supported by a frame member, indicated generally by the reference numeral 18, which supports the entire scale module 10. An intermediate feeding assembly, indicated generally by the reference numeral 20, includes a transport belt 22 which passes around a plurality of drive rollers 24 so as to project through apertures 26 in the platform 14, and a plurality of feed rollers 28 which project through other apertures 30 in the platform 14. The guide rollers 24 are suitably driven by a motor 32 having an output connected to one of the rollers 24, and the feed rollers 28 are driven by the same motor through an output connected to the roller 28 adjacent to the motor 32, and a plurality of gears 34 transfer the drive to the other feed roller 28. Further details of the intermediate feeding assembly 20 are not necessary for an understanding of the invention.

The scale module 10 also includes a pressure roller assembly, indicated generally by the reference numeral 36, which includes a plurality of individual pressure rollers 38 mounted on the end of arms 40 which in turn are mounted on an elongate housing 42 and urged downwardly by suitable resilient means so that the pressure rollers 38 maintain driving contact with the portions of the belt 22 that project through the openings 26. The housing 42 is fixedly mounted to a rearward extension 44 of the platform 14 by means of a suitable bracket 46. The pressure roller assembly 36 also includes a plurality of fowardly extending arms 48 suitably connected to the housing 42, and which support additional pressure rollers 50 mounted on fingers 52 pivotally connected to the free end of the arms 48, and which are urged downwardly by suitable resilient means to urge the rollers 50 into driving engagement with the rollers 28 projecting through the openings 30 in the platform 14.

From the foregoing, it will be seen that the intermediate feeding assembly 20 and the upper pressure roller assembly 36 cooperate to feed envelopes E onto and across the scale platform 14, and to stop the envelopes E at the appropriate moment to permit the scale to weigh each envelope and set the postage meter module 12 so it will print an appropriate postage indicia on the envelopes. For a more thorough description and understanding of the scale module 10, reference is hereby made to copending application Ser. No. 272,408, filed Jul. 8, 1994, in the name of Thomas M. Lyga, and assigned to the assignee of this application.

Still referring to FIG. 2, it will be seen that another feed roller 58 is mounted on a shaft 54 which extends outwardly from the roller 24 adjacent to the motor 32,the feed roller 58 projecting upwardly through an aperture 56 formed in the rearward extension 44 of the scale platform 14. The aperture 56 is position to be in line with the flap F of the envelope E as the latter moves from the storage and feeding module (not shown) onto the platform 14.

As best seen in FIGS. 1 and 2, the adjustable pressure roller device of the present invention, indicated generally by the reference numeral 60, is mounted on the bracket 46 by means of screws 62 which pass through apertures in an end wall 64 of an elongate housing comprising the end wall 64, a top wall 66 and opposed side walls 68.

Considering now all of the views, the device 60 further comprises an arm 70 which is pivotally connected as at 71 to side walls 68 of the housing adjacent one end thereof, the arm 70 having a pressure roller 72 mounted on the free end thereof so as to overlie the feed roller 58 when the device is assembled to the scale module 10 as described above. The other end of the arm 70 is provided with a finger 74 which extends beyond the axis of rotation 71 of the arm 70 relative to the side walls 68 and which is disposed at a slight obtuse angle with respect to the arm 70 so as to be close to vertically oriented when the arm 70 is disposed somewhat below horizontal, as best seen in FIG. 3.

Figure 3:
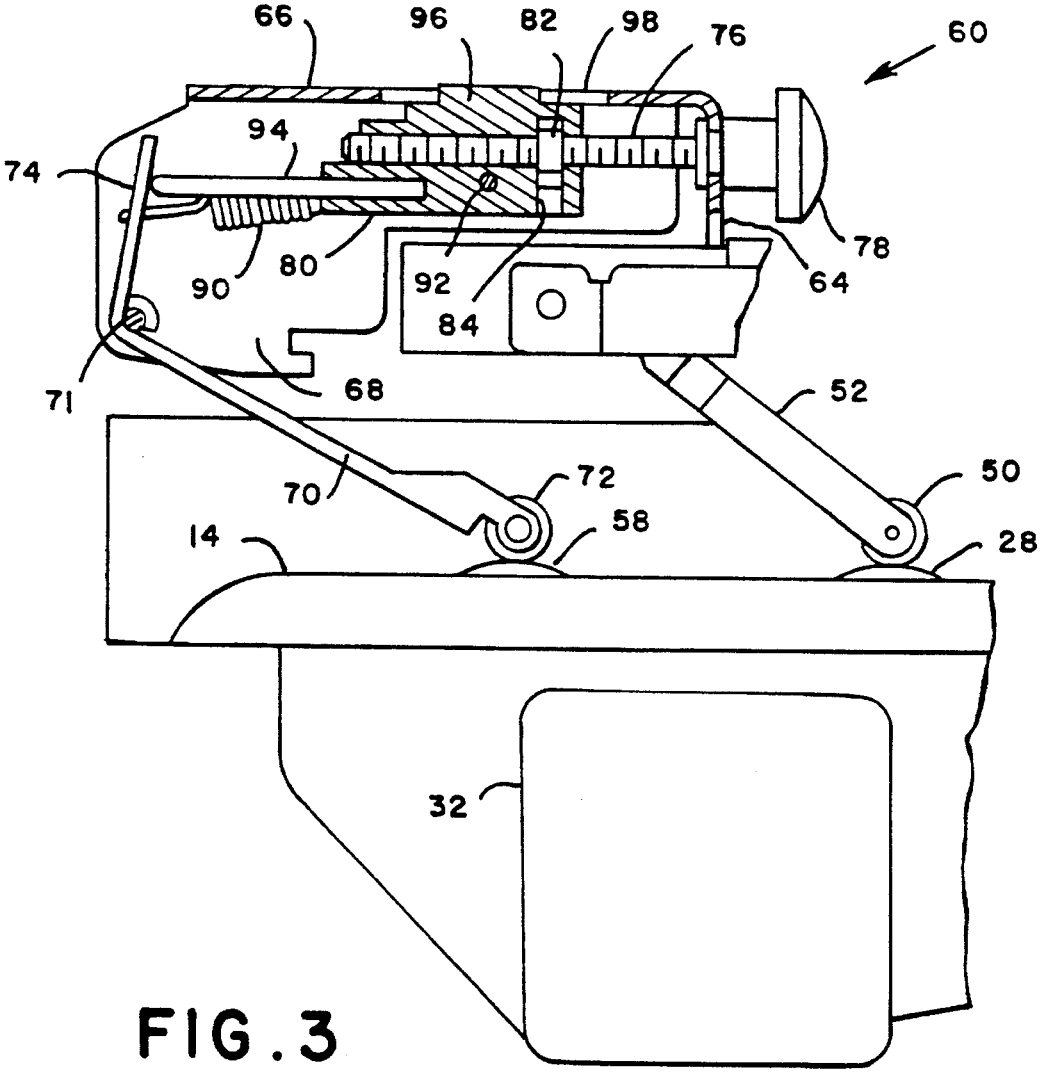
FIG. 3 is a partial side elevation of the envelope drive of the the scale module and showing the pressure roller assembly of the present invention in side section on the line 3—3 of FIG. 1.
Figure 4:
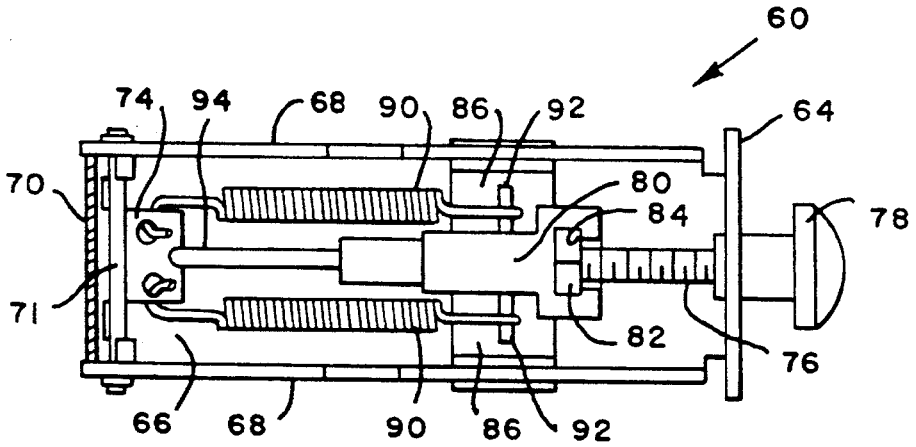
FIG. 4 is view looking upwardly at the underside of the pressure roller assembly of the present invention with a portion of a pressure roller arm removed to reveal internal details.

As best seen in FIGS. 3 and 4, a threaded shaft 76 is rotatably mounted in the front wall 64 of the elongate housing and is provided with a finger knob 78 by which the shaft 76 is manually rotated. A slider block 80 is disposed in the spaced defined by the top wall 66 and the side walls 68 and is threadedly engaged with the shaft 76 by means of a nut 82 which is non-rotatably captured within a pocket 84 formed in the end of the slider block 80 adjacent the finger knob 78. The slider block is constrained against rotation by means of a pair of wings 86 having terminal portions which project through slots 88 formed in the side walls 68, as best seen in FIG. 1.

A pair of tension springs 90 are also disposed in the housing and are connected at one end to the finger 74 of the arm 70 and at the other end to a pin 92 which extends through the slider block 80, the springs 90 biasing the finger 74 and arm 70 in a clockwise direction about the pivot axis 71 so as to urge the pressure roller 72 into driving engagement with the feed roller 58. One end of a rod 94 is fixedly mounted in the slider block 80 for movement therewith, the other end of the rod 94 contacting the finger 74 of the arm 70, so as to push against the finger 74 and move it against the bias of the tension springs 90 when the shaft 76 is rotated in one direction, thereby pivoting the arm 70 in a counter-clockwise direction about the pivot axis 71 to raise the roller 72 out of contact with the roller 58. However, if the shaft 76 is rotated in either direction while the pressure roller 72 remains in contact with the roller 58, the spring tension can be increased or decreased because only the ends of the springs connected to the pin 92 move with the slider block 80, since the end of the rod 94 is out of contact with the finger 74 and therefore has no effect on the arm 70, thereby increasing or decreasing the length of the springs. This provides the advantage of adjusting the amount of driving pressure on different forms of evelopes during feeding operations.

As best seen in FIGS. 1 and 3, the slider block 80 is provided with a raised protuberance 96 which extends through a slot 98 in the upper wall 66 of the elongate housing to provide a visual indication of the location of the pressure roller 72 relative to the feed roller 58. If desired, a scale can be provided with graduations for indicating the location of the pressure roller 72 with respect to the housing, and also to indicate which way to turn the finger knob 78 to move the pressure roller 72 toward or away from the feed roller 58.

From the foregoing description, the operation of the device should be apparent. As best seen in FIG. 3, from the position of the parts as shown therein, if the finger knob 78 is rotated in a counter clockwise direction when viewed from the front of the finger knob 78, the threaded shaft 76 will rotate in the same direction in the non-rotatable nut 82, thereby moving the slider 80 toward the left away from the finger knob 78. Movement of the slider block 80 in this direction pushes the rod 94 against the finger 74 to pivot the finger 74 and the arm 70 in a counter clockwise direction about the pivot axis 71, thereby moving the pressure roller 72 away from the feed roller 58. This will either decrease the amount of pressure that the pressure roller 72 will exert on a paper item passing between the feed roller 58 and the pressure roller 72, or entirely remove the pressure roller 72 from contact with any paper item passing over the feed roller 58. Rotation of the finger knob 78 in a clockwise direction will turn the threaded shaft 76 in the same direction in the non-rotatable nut 82, thereby moving the slider 90 toward the right, i.e., toward the finger knob 78. Movement of the slider block 80 in this direction pulls the rod 94 with it and allows the tension springs 90 to pivot the finger 74 and the arm 70 in a clockwise direction about the pivot axis 71, thereby moving the pressure roller 72 toward the feed roller 58.

It should be noted that a particularly unique feature of the present invention is that, as long as the pressure roller 72 is out of contact with the feed roller 58, rotation of the finger knob 78 in either direction moves both the slider block 80 and the finger 74 by the same amount, with the result that the tension on the tension springs 90 remains unchanged from a preset amount. This is because the tension springs 90 are connected at one end to the pin 92 mounted in the slider block and at the other end to the finger 74 which is also effectively connected to the slider block 80 through the rod 94. Thus, as the slider block 80 moves back and forth, the points of connection of the tension springs 90 to the finger 74 moves back and forth in synchronism with the movement of the slider block 80 because the points of connection of the tension springs 90 to the finger 74 are substantially in horizontal alignment with the movement of the slider block 80 and the rod 94. The result is that the pressure roller 72 will exert the same amount of pressure on any thickness of paper item passing between it and the feed roller 58 if the finger knob 78 is set so that the end of the rod 94 normally engaging the finger 74 is just barely touching the finger 74 with a given thickness of paper item disposed between the pressure roller 74 and the feed roller 58. Once this setting is made for a given thickness of paper item, if a thicker paper item is passed between the pressure roller 72 and the feed roller 58, thereby raising the pressure roller 72 and pivoting the arm 70 and finger 74 in a clockwise direction, the tension springs 90 will be stretched, thereby increasing the pressure exerted by the pressure roller 72 on such thicker paper item.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

I claim:

1. In a paper feeding machine having means defining a feed path along which various items of paper are adapted to be fed and feed roller means disposed on one side of said feed path for feeding said items of paper along said feed path, an adjustable pressure roller device for maintaining proper feeding pressure between said items of paper and said feed roller means, said device comprising:

A. a back up pressure roller disposed on the opposite side of said feed path in juxtaposition to said feed roller means, B. means mounting said pressure roller for movement toward and way from said feed roller means to vary the amount of pressure exerted by said pressure roller against a paper item disposed between said pressure roller and said feed roller means between a preset maximum and zero, said mounting means including:

an elongate housing mounted in spaced relationship to said paper feed path, an arm pivotally connected to said housing adjacent one end of said arm for movably supporting said pressure roller, said arm having an integral finger that extends beyond said one end of said arm, said pressure roller rotatably mounted to the other end of said arm for movement toward and away from said feed roller means, resilient means interconnected between said finger and said housing for normally urging said pressure roller toward said feed roller means, and C. actuating means for controlling the direction and extent of movement of said pressure roller, whereby said pressure feeding device can accommodate a wide variety of thicknesses, types and grades of paper without risk of mutilating or misfeeding the paper.

2. An adjustable pressure feeding device as set forth in claim 1 wherein said actuating means comprises manually adjustable means for moving said pressure roller away from said paper feed path against the bias of said resilient means.

3. An adjustable pressure feeding device as set forth in claim 2 wherein said manually adjustable means comprises A. a threaded shaft rotatably supported in said housing adjacent the end of said housing opposite said one end thereof, B. a slider non-rotatably mounted on said shaft, said slider being threadedly engaged with said shaft for moving therealong in response to rotation of said shaft, said resilient means being connected to said slider, and C. means mounted on said slider for engaging said finger to pivot said arm in a direction to move said pressure roller away from said feed path against the bias of said resilient means in response to rotation of said shaft in one direction.

4. An adjustable pressure feeding device as set forth in claim 3 wherein said slider includes means projecting laterally therefrom which extends through apertures in opposite sides of said housing, thereby constraining said slider against rotation on said shaft.

5. An adjustable pressure feeding device as set forth in claim 4 wherein said slider further includes indicator means projecting through an aperture in a top wall of said housing, the position of said indicator means indicating the degree of pressure exerted by said pressure roller for a given thickness of paper.

6. A pressure roller device for maintaining proper feeding pressure between a paper item and feed means, said feed means for feeding said paper item in a path of travel, said device comprising:

A. an elongate housing mounted in spaced relationship to said feed means,

B. a pressure roller pivotally mounted to said housing to move toward and away from operative engagement with said feed means, C. resilient means for biasing said pressure roller toward said feed means, D. actuating means for moving said pressure roller away fro against the bias of said resilient means, and E. an arm having a first end with said pressure roller rotatably mounted thereto and a second end pivotally connected to said housing, and wherein:

said actuating means includes a slider slideably mounted to said elongate housing to be repositionable along said elongate housing, and said arm includes an integral finger extending beyond said second end and said resilient means is connected between said integral finger and said slider.

7. A pressure feeding device as set forth in claim 6 wherein said slider includes rod means for engaging said integral finger to pivot said arm and move said pressure roller away from said feed means when said slider is repositioned along said elongate housing in a first direction.

8. A pressure feeding device as set forth in claim 7 wherein when said slider is repositioned in a second direction along said elongate housing, said rod means disengages from said integral finger causing said resilient means to pivot said arm until said pressure roller contacts said feed means.

* * * * *